US008827006B2

(12) United States Patent
Moriarty

(10) Patent No.: US 8,827,006 B2
(45) Date of Patent: Sep. 9, 2014

(54) APPARATUS AND METHOD FOR MEASURING WHILE DRILLING

(75) Inventor: Keith A. Moriarty, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 782 days.

(21) Appl. No.: 11/127,606

(22) Filed: May 12, 2005

(65) Prior Publication Data

US 2006/0254819 A1 Nov. 16, 2006

(51) Int. Cl.
*E21B 47/18* (2012.01)
*E21B 7/06* (2006.01)

(52) U.S. Cl.
CPC ..... *E21B 47/18* (2013.01); *E21B 7/068* (2013.01)
USPC ..... 175/40

(58) Field of Classification Search
USPC ..... 175/40, 50
See application file for complete search history.

(56) References Cited

U.S. PATENT DOCUMENTS

| | | | | |
|---|---|---|---|---|
| 4,842,081 | A | 6/1989 | Parant | |
| 5,073,877 | A | 12/1991 | Jeter | |
| 5,117,927 | A | 6/1992 | Askew | |
| 5,197,553 | A | 3/1993 | Leturno | |
| 5,265,682 | A | 11/1993 | Russell et al. | |
| 5,375,098 | A | 12/1994 | Malone et al. | |
| 5,448,227 | A | 9/1995 | Orban et al. | |
| 5,459,697 | A * | 10/1995 | Chin et al. | 367/81 |
| 5,472,057 | A | 12/1995 | Winfree | |
| 5,517,464 | A | 5/1996 | Lerner et al. | |
| 5,520,255 | A | 5/1996 | Barr et al. | |
| 5,553,678 | A | 9/1996 | Barr et al. | |
| 5,582,259 | A | 12/1996 | Barr | |

(Continued)

FOREIGN PATENT DOCUMENTS

| | | |
|---|---|---|
| EP | 0462618 | 6/1991 |
| EP | 1 006 260 | 12/1999 |

(Continued)

OTHER PUBLICATIONS

Baker Hughes Incorporated copyright of 2001; "The AutoTrak® System"; 16 pages.

(Continued)

*Primary Examiner* — D. Andrews
(74) *Attorney, Agent, or Firm* — Chadwick A. Sullivan; Brigitte Echols

(57) ABSTRACT

An apparatus, system, and method for transmitting measurements while drilling are adapted for use with a drill string equipped with a mud motor. The drill string may comprise a plurality of interconnected drill pipe joints or a plurality of interconnected casing joints. The apparatus comprises a measurement-while-drilling tool adapted for placement in the drill string beneath the mud motor. The measurement-while-drilling tool has a system for transmitting telemetry signals, such as mud-pulse telemetry signals, upwardly through the mud motor and the drill string. In particular embodiments, the measurement-while-drilling tool has a system for transmitting mud-pulse telemetry signals upwardly through the mud motor and the drill string at frequencies below approximately 1 Hz, although other frequencies may be employed to advantage. The apparatus may further comprise a rotary steerable system for placement in the drill string beneath the mud motor. The rotary steerable system may be a point-the-bit system or a push-the-bit system. In particular embodiments, the rotary steerable system and the measurement-while-drilling tool are integrated.

20 Claims, 5 Drawing Sheets

(56) References Cited

U.S. PATENT DOCUMENTS

| | | | | |
|---|---|---|---|---|
| 5,602,541 | A * | 2/1997 | Comeau et al. | 340/853.3 |
| 5,685,379 | A | 11/1997 | Barr et al. | |
| 5,695,015 | A | 12/1997 | Barr et al. | |
| 5,706,905 | A | 1/1998 | Barr | |
| 5,803,185 | A | 9/1998 | Barr et al. | |
| 5,812,068 | A * | 9/1998 | Wisler et al. | 340/855.5 |
| 5,845,722 | A | 12/1998 | Makohl et al. | |
| 5,950,742 | A | 9/1999 | Caraway | |
| 6,057,784 | A | 5/2000 | Schaaf et al. | |
| 6,092,610 | A | 7/2000 | Kosmala et al. | |
| 6,158,531 | A | 12/2000 | Vail, III | |
| 6,196,336 | B1 | 3/2001 | Fincher et al. | |
| 6,206,108 | B1 | 3/2001 | MacDonald et al. | |
| 6,219,301 | B1 | 4/2001 | Moriarty | |
| 6,233,524 | B1 | 5/2001 | Harrell et al. | |
| 6,263,987 | B1 | 7/2001 | Vail, III | |
| 6,378,626 | B1 | 4/2002 | Wallace | |
| 6,419,033 | B1 | 7/2002 | Hahn et al. | |
| 6,516,898 | B1 | 2/2003 | Krueger | |
| 6,705,413 | B1 | 3/2004 | Tessari | |
| 6,732,052 | B2 | 5/2004 | Macdonald et al. | |
| 2002/0040787 | A1 | 4/2002 | Cook et al. | |
| 2002/0050360 | A1 | 5/2002 | Cook et al. | |
| 2002/0175003 | A1 | 11/2002 | Pisoni et al. | |
| 2002/0179336 | A1 | 12/2002 | Schaaf et al. | |
| 2003/0127252 | A1 * | 7/2003 | Downton et al. | 175/73 |
| 2004/0026126 | A1 | 2/2004 | Angman | |
| 2004/0104051 | A1 | 6/2004 | Moriarty et al. | |
| 2004/0251048 | A1 | 12/2004 | Kurkoski | |
| 2004/0256157 | A1 | 12/2004 | Tessari et al. | |

FOREIGN PATENT DOCUMENTS

| | | |
|---|---|---|
| GB | 2261308 | 5/1993 |
| GB | 2357539 | 6/2001 |
| WO | 9848140 | 10/1998 |
| WO | 0028188 | 5/2000 |
| WO | WO 01/94738 | 12/2001 |
| WO | WO2004011775 | 2/2004 |

OTHER PUBLICATIONS

Schlumberger website (www.slb.com/oilfield); Feb. 2004; "PowerDrive X5"; 5 pages.

Schlumberger website (www.connect.slb.com); Oct. 2002; "PowerDrive Xtra Series"; 7 pages.

Schlumberger website (www.slb.com/oilfield); Jun. 2003; "PowerDrive Xceed"; 5 pages.

Website (www.worldoil.com/Magazine); Jun. 19, 2002; Casing Drilling Successfully Applied in Southern Wyoming; 9 pages.

"Casing Drilling General Arrangement & Rig Schematic".; K. Moriarty; Mar. 10, 2005; 3 pages.

World Oil 2003 Casing Drilling Technical Conference: "Rotary Drilling with Casing—a field proven method of reducing wellbore construction cost"; Mar. 6, 2003; G. Galloway; WOCD-0306-02; 7 pages.

International Association of Drilling Contractors; IADC/SPE 62780, copyright 2000; "Development of a Casing/Drilling System Improves the Drilling Process"; E. Skinazi, SPE; R. Deady, SPE; D. Robson; C. Konschuh; Sperry-Sun Drilling Services; 6 pages.

International Association of Drilling Contractors; IADC/SPE 67731, copyright 2001; "Casing Drilling: An Emerging Technology"; S. R. Shepard, SPE, and R. H. Reiley, SPE, BP, and T. M. Warren, SPE, Tesco Corp.; 13 pages.

Schlumberger website (www.oilfield.slb.com); "Vision and Pulse case study, Horn Mountain: Focus on well placement"; 1 page.

International Association of Drilling Contractors; IADC/SPE 59126 copyright 2000; "Simultaneous Drill and Case Technology—Case Histories, Status and Options for Further Development"; Detlef Hahn (SPE), Baker Hughes Inteq, Wilhelmus Van Gestel (SPE), BP Amoco Norway AS, Norbert Frohlich, Baker Hughes Inteq, Glenn Stewart, Baker Hughes Inteq.; 9 pages.

International Association of Drilling Contractors; SPE/IADC 52789 copyright 1999; "Casing Drilling—A Revolutionary Approach to Reducing Well Costs"; R.M. (Bob) Tessari, SPE, and Garret Madell, SPE, Tesco Corporation; 9 pages.

International Association of Drilling Contractors; IADC/SPE 59179 copyright 2000; "Casing Drilling Application Design Considerations"; Tommy M. Warren, SPE, Tescon Drilling Technology, Per Angman, SPE, Tesco Corp., Bruce Houtchens, SPE, Tesco Drilling Technology; 11 pages.

Baker Hughes Incorporated, copyright 2004; "RotarySteerableSystems—unlocking.The value"; A Guide to the History, Applications and Future of Rotary Steerable Technology by John L. Kennedy; 23 pages.

Oilfield Review, Spring 2000; "New Directions in Rotary Steerable Drilling"; Geoff Downton, Andy Hendricks, Trond Skei Klausen and Demos Pafitis; 12 pages.

Website (www.oilonline.com); The Original Online Source for the Oil Industry; "Ready for the offshore reckoning"; Rick von Flatem; Dec. 1, 2004; 5 pages.

Website (www.tescocorp.com/casingdrilling); Tesco the Drilling Innovation Company™; "Casing Drilling™ Report—A safer, more efficient way to reach the reservoir"; 5 pages.

Website (www.tescocorp.com); Tesco the Drilling Innovation Company™; Bulletin 41000e; "Casing Drive Systems"; 4 pages.

Website (www.connect.slb.com); Schlumberger Aug. 2002; "SlimPulse: Next generation retrievable MWD tool"; 2 pages.

Website (www.connect.slb.com); Schlumberger—date unknown; PowerPulse brochure; 1 page.

Website (www.connect.slb.com); Schlumberger—date unknown; IMPulse brochure; 1 page.

"A Guide to Understanding Rotary Steerable Technology", Baker Hughes INTEQ; Jon Ruszka; pp. 12-19.

"Powering UIp to Drill Down"; Oilfield Review; Pierantonio Copercini, Farag Soliman, Mohamed El Gamal, Wayne Longstreet, Jon Rodd, Mark Sarssam, Iain McCourt, Barry Persad, and Mike Williams; Winter 2004/2005; pp. 4-9.

* cited by examiner

APPARATUS AND METHOD FOR MEASURING WHILE DRILLING

BACKGROUND OF THE INVENTION

1. Field of the Invention

This invention relates generally to an apparatus and method for making downhole measurements during the drilling of a wellbore. More particularly, it relates to an apparatus and method for making downhole measurements at or near the drill bit during directional drilling of a wellbore.

2. Background of the Related Art

The drilling of oil and gas prospecting wells, also know as "boreholes," typically involves the use of a drilling assembly—particularly a directional drilling assembly—for penetrating one or more subsurface formations of interest. Such drilling assemblies, also known as "drill strings," typically include lower sections known as "bottom-hole assemblies" or BHAs. A BHA may consist (generally from the bottom up in a vertical borehole section) of a drill bit, bit sub, stabilizers, drill collars, directional drilling equipment, measurement-while-drilling (MWD) tools, logging-while-drilling (LWD) tools, drill pipe, and other specialized devices. The MWD tools and LWD tools acquire data that is representative of various drilling, drill bit, and formation parameters. Acquired drilling parameters may include the direction and inclination (D&I), and toolface of the BHA; acquired drill bit parameters may include measurements such as weight on bit (WOB), torque on bit and drive shaft speed; and acquired formation parameters may include resistivity (or conductivity), natural radiation, density (natural gamma ray or neutron emission), pore pressure, and other parameters that characterize the formation.

MWD tools are often equipped with an integrated telemetry system and are placed in communication with LWD tools (or integrated therewith), so that the telemetry system of the MWD tools may be employed for transmitting real time or near-real time signals representing the acquired drilling, drill bit, and formation parameters to the surface for processing and interpretation. Examples of MWD tools and associated telemetry systems are described in U.S. Pat. No. 5,375,098 by Malone et al., U.S. Pat. No. 5,517,464 by Lerner et al., and U.S. Pat. No. 6,219,301 to Moriarty, each of which is assigned to the assignee of the present invention.

When a conventional MWD tool is used in combination with a mud motor (i.e., in a drill string that employs a mud motor), the MWD tool is located above the mud motor at a substantial distance from the drill bit. Thus, it is not unusual for an MWD tool to be positioned as much as 40 feet above the drill bit, considering the length of a non-magnetic spacer collar and other components that are typically connected in the drill string between the MWD tool and the motor. Such substantial distances between the sensors in the MWD tool (and possibly a LWD tool) and the drill bit mean that the sensors' measurements of the downhole conditions (e.g., drilling, drill bit, and/or formation parameters) are made a substantial time after the drill bit has passed the formation location from which the measurements are taken. Therefore, if there is a need to adjust the borehole trajectory based on information from the MWD/LWD sensors, the drill bit will have already traveled some considerable distance before the need to adjust its direction is apparent. Adjustment of the borehole trajectory under these circumstances can be a difficult and costly task. Accordingly, there is a desire in many drilling applications, especially when drilling directional wells, to make the downhole measurements as close to the drill bit as possible.

The intentional directional control of a borehole, commonly known as "directional drilling," may be based upon three-dimensional targets in space (e.g., from seismic images), upon the results of downhole geological logging measurements (e.g., by geosteering), or upon other information with the usual objective of targeting or keeping a directional borehole within a valuable formation (i.e., within a so-called "pay zone"). Directional drilling is generally achieved by pointing or pushing the drill bit in the intended borehole direction. The most common way of pointing the bit is through the use of a bend near the bit in a downhole steerable mud motor assembly. The bend is commonly introduced by a bent housing in the mud motor assembly, which is selectively rotated to point-the-bit in a direction different from the axis of the wellbore. Then, when mud is pumped through the mud motor while the drill string rotation is stopped, the bit is rotated about its axis to drill in the direction the bit has been pointed. The bent housing may employ a fixed or adjustable bend. One example of an adjustable bent housing is described in U.S. Pat. No. 5,117,927, assigned to the assignee of the present invention.

Another way of pointing the drill bit, or, alternatively, of pushing the bit, for directional drilling purposes is achieved through a rotary steerable system (RSS), also known as a rotary steerable tool (RST). A RSS allows directional drilling to proceed while the drill string is rotating, usually with higher rates of penetration and ultimately smoother boreholes than are achievable with mud motors. A RSS (embodiments of which are described in detail below) may include D&I sensors, system control electronics, power generation equipment, and communication links, in addition to its steering components. Since many of these elements are provided in a MWD tool, there will be some redundancy in a drill string employing a RSS with a MWD tool. Thus, with the advancement of RSS and MWD/LWD technology, it has become advantageous to consider their integration into a single assembly in order to move measurement sensors closer to the bit and reduce costs downhole through the elimination of duplicate elements and functionalities.

Additionally, since drilling time equates to increased cost, it is generally preferred to conduct drilling at the highest rate possible, i.e., to achieve the highest rate of penetration (ROP) through the subsurface earth. This often dictates that the drill string be rotated at speeds that approach the limits of the rotary table, thereby increasing the wear on the drill string and the casing. For this reason (as well as others, such as enhanced performance), the practice of combining a RSS (which directs the bit while the drill string is rotated) with a mud motor (which directs the bit while the drill string is not rotating) has recently been proposed. The above-mentioned desire to make downhole measurements (e.g., MWD/LWD) as close to the drill bit as possible also applies to such combinations of a mud motor with a RSS.

In conventional drilling operations, a borehole is drilled to a selected depth with a drill string having numerous interconnected joints of heavyweight pipe called drill pipe (as well as a BHA as described herein), and then the borehole is lined with a larger-diameter pipe called casing. Casing typically consists of larger-diameter pipe joints connected end-to-end, similar to the way the drill pipe is connected. To accomplish the setting of casing in the borehole, the drill string including the BHA are removed from the borehole in a process called "tripping." Once the drill string is removed, the casing is lowered into the borehole and cemented in place. The casing protects the borehole from collapse and isolates the subsurface formations from each other. After the casing is set in place, drilling may continue.

Conventional drilling typically includes a series of drilling, tripping, casing, and cementing sequences that are repeated again and again as the borehole penetrates the subsurface earth. This process is very time consuming and costly. Additionally, other problems are often encountered when tripping the drill string. For example, the drill string (or a portion thereof) may get stuck in the borehole while it is being removed. These problems require additional time and expense to resolve. As a result, the practice of casing drilling (also called liner drilling in some instances), wherein casing is employed as the drill pipe, has recently been commercialized. In casing drilling, a BHA including a drill bit are connected to the lower end of a casing string, and the borehole is drilled using the casing string to transmit mud, as well as axial and rotational forces, to the drill bit. Upon completion of drilling, the casing string may then be cemented in place to form the casing for the borehole. Casing drilling thus enables the borehole to be simultaneously drilled and cased.

Casing drilling is adaptable to the employment of measuring and directional drilling tools/systems as described herein. Examples of casing drilling strings that employ mud motors and MWD tools are described in U.S. Pat. No. 5,197,553 by Leturno, U.S. Pat. No. 6,196,336 by Fincher et al., and U.S. Patent Application Publication No. 2004/0026126 by Angman. Examples of casing drilling strings that employ RSS and MWD tools are described in U.S. Pat. No. 6,419,033 by Hahn et al., and U.S. Pat. No. 6,705,413 by Tessari. However, the desires and shortcomings identified above (among others) concerning conventional drilling strings are evident in these casing drilling strings.

SUMMARY OF THE INVENTION

In response to the desires and needs identified herein, as well as other shortcomings in the relevant art, the present invention in its various aspects is generally directed to the placement of measuring sensors and telemetry systems in relatively close proximity to a drill bit, so as to improve cost efficiency as well as drilling performance. The present invention is adaptive to various drill strings, including conventional and casing drill strings, and is particularly suited for use in drill strings employing directional drilling systems such as mud motors and/or RSS.

In one aspect, the present invention provides an apparatus for transmitting measurements while drilling with a drill string equipped with a mud motor. The inventive apparatus comprises a measurement-while-drilling tool adapted for placement in the drill string beneath the mud motor. The measurement-while-drilling tool has a system for transmitting telemetry signals, such as mud-pulse telemetry signals, upwardly through the mud motor and the drill string. The mud motor may comprise a positive displacement motor or a turbine.

In particular embodiments, the telemetry system is adapted for transmitting mud-pulse telemetry signals upwardly through the mud motor and the drill string at frequencies below approximately 1 Hz. The telemetry system may comprise a valving system for intermittently restricting the flow of mud through the measurement-while drilling tool.

In particular embodiments, the apparatus further comprises a rotary steerable system for placement in the drill string beneath the mud motor. The rotary steerable system may be a point-the-bit system or a push-the-bit system.

In particular embodiments, the drill string comprises a plurality of interconnected drill pipe joints or a plurality of interconnected casing joints.

In particular embodiments, the rotary steerable system and the measurement-while-drilling tool are integrated into a common tool housing.

In a further aspect, the present invention provides a system for transmitting measurements while drilling, comprising a drill string having a drill bit at one end thereof for drilling a borehole through a subsurface formation. A mud motor is carried in the drill string above the drill bit, and a measurement-while-drilling tool is carried in the drill string beneath the mud motor. The measurement-while-drilling tool has a system for transmitting telemetry signals, such as mud-pulse telemetry signals, upwardly through the mud motor and the drill string, e.g., at frequencies below approximately 1 Hz. In particular embodiments, the system further comprises a rotary steerable system carried in the drill string beneath the mud motor.

In another aspect, the present invention provides a method for transmitting measurements while drilling, for use in a drill string having a mud motor and a drill bit. The method comprises measuring one or more parameters of a subsurface formation penetrated by the drill string. Telemetry signals, such as mud-pulse telemetry signals, are generated beneath the mud motor that are representative of the measured formation parameters, and the generated telemetry signals are transmitted upwardly through the mud motor and the drill string (e.g., mud-pulse telemetry signals at frequencies below approximately 1 Hz). In particular embodiments, the drill bit is steered with a rotary steerable system carried in the drill string beneath the mud motor.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
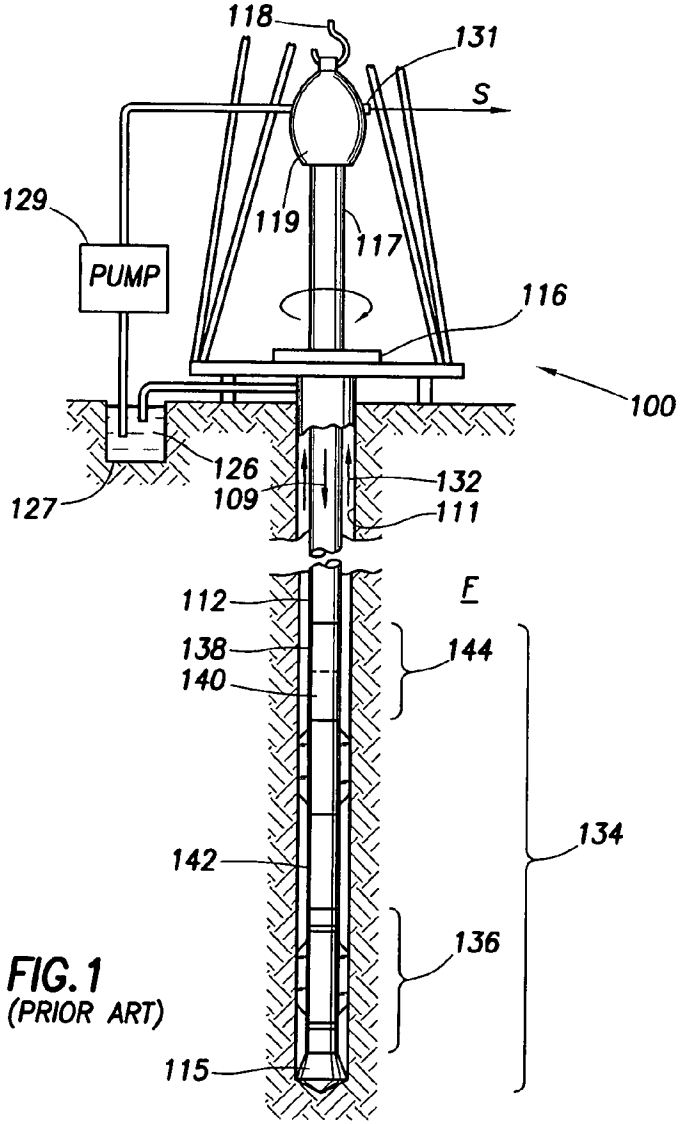
FIG. 1 (PRIOR ART)
FIG. 1 is an elevational representation of a conventional drill string.

FIG. 1 illustrates a conventional drilling rig and drill string in which the present invention can be utilized to advantage. A land-based platform and derrick assembly 100 are positioned over a borehole 111 penetrating a subsurface formation F. In the illustrated embodiment, the borehole 111 is formed by rotary drilling in a manner that is well known. Those of ordinary skill in the art given the benefit of this disclosure will appreciate, however, that the present invention also finds application in drilling applications other than conventional rotary drilling (e.g., mud-motor based directional drilling, and/or rotary-steerable drilling, as described elsewhere herein), and is not limited to land-based rigs.

A drill string 112 is suspended within the borehole 111 and includes a drill bit 115 at its lower end. The drill string 112 is rotated by a rotary table 116, energized by means not shown, which engages a kelly 117 at the upper end of the drill string. The drill string 112 is suspended from a hook 118, attached to a traveling block (also not shown), through the kelly 117 and a rotary swivel 119 which permits rotation of the drill string relative to the hook.

Drilling fluid, or mud, 126 is stored in a pit 127 formed at the well site. A pump 129 delivers the mud 126 to the interior of the drill string 112 via a port in the swivel 119, inducing the mud to flow downwardly through the drill string 112 as indicated by the directional arrow 109. The mud exits the drill string 112 via ports in the drill bit 115, and then circulates upwardly through the region between the outside of the drill string and the wall of the borehole, called the annulus, as indicated by the directional arrows 132. In this manner, the mud lubricates the drill bit 115 and carries formation cuttings up to the surface as it is returned to the pit 127 for recirculation.

The drill string 112 includes a bottom-hole assembly (BHA) 134 that includes the drill bit 115 and several drill collar lengths above the drill bit. The BHA 134 includes capabilities for measuring, processing, and storing information, as well as communicating with the surface. The BHA 134 thus includes, among other things, an apparatus 136 for determining and communicating one or more properties of the formation F surrounding borehole 111, such as formation resistivity (or conductivity), natural radiation, density (gamma ray or neutron), and pore pressure.

The BHA 134 further includes drill collars 142, 144 for performing various other measurement functions. Drill collar 144, for example, may houses a measurement-while-drilling (MWD) tool. The MWD tool includes a telemetry and power subassembly 138 that communicates with surface transducers, represented by reference numeral 131, that convert the signals received from the subassembly 138 to electronic signals S for further processing, storage, and use. The subassembly 138 powers and establishes communication with/for a sensor package 140 within the MWD tool. The sensor package 140 may include appropriate instrumentation for determining real-time drilling parameters such as direction, inclination, and toolface, among other things.

Figure 2:
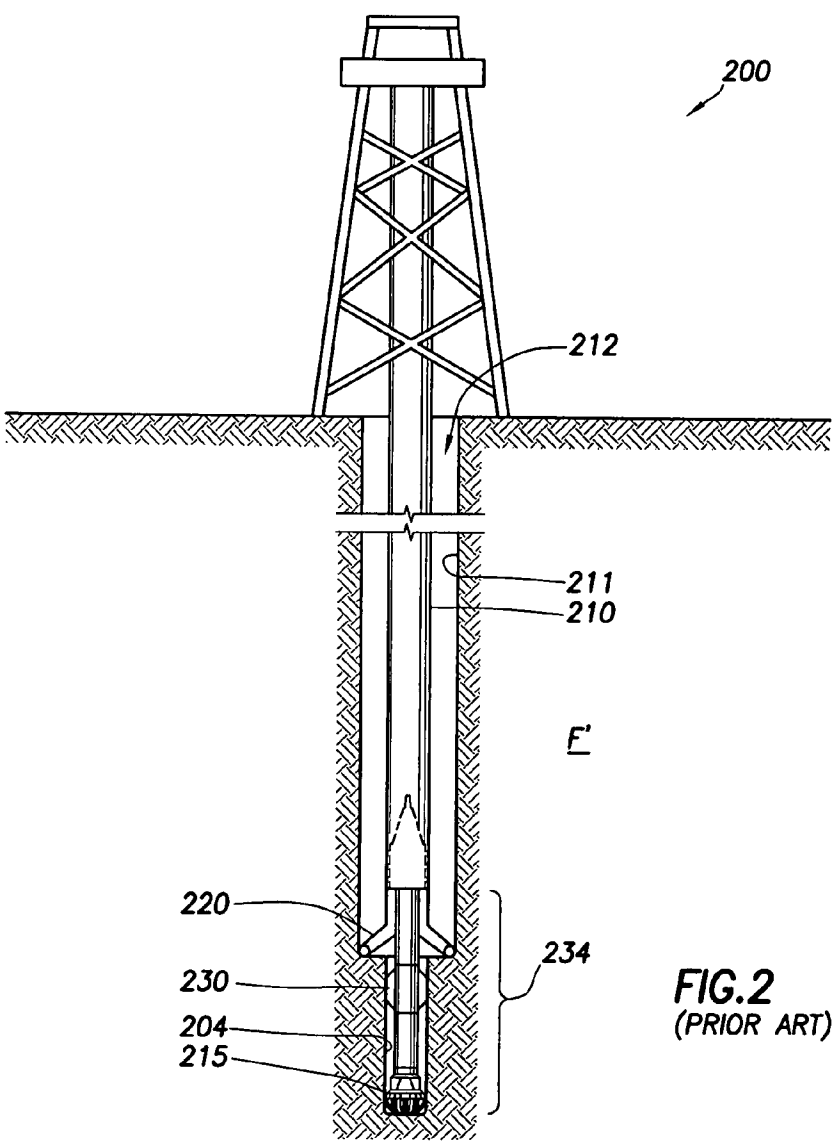
FIG. 2 (PRIOR ART)
FIG. 2 is an elevational representation of a drill string employing casing as drill pipe.

FIG. 2 shows a prior art casing drilling operation. A drilling rig 200 at the surface is used to rotate a drill string 210 comprised of casing (i.e., a casing string) by way of a rotary table or a top drive assembly (neither are particularly shown), as are known in the relevant art. The casing string 210 is adapted for drilling through the subsurface formation F' in a known manner to form a borehole 211. A BHA 234 is connected at the lower end of the casing string 210, and includes an underreamer 220, a centralizer/stabilizer 230, and a drill bit 215. It will be appreciate by those skilled in the art that the BHA 234 may be equipped with other components, as will be described elsewhere herein, although such other components are eliminated for simplicity in FIG. 2. The components of the BHA 234 may be sized to facilitate their retrieval upwardly through the casing string 210 when drilling has been completed or when replacement and maintenance of the drill bit 215 is required.

The drill bit 215 drills a pilot hole 204 that is enlarged by the underreamer 220 so that the casing string 210 will fit into the resulting borehole 211. The underreamer 220 is adapted for operating in an extended position and running in a retracted position. In the extended position (shown in FIG. 2), the underreamer-220 is able to enlarge the pilot hole 204 to the borehole size required for running the casing string 210. In the retracted position (not shown), the underreamer arms are withdrawn so that the underreamer is able to travel through the interior of the casing string 210.

Figure 3:
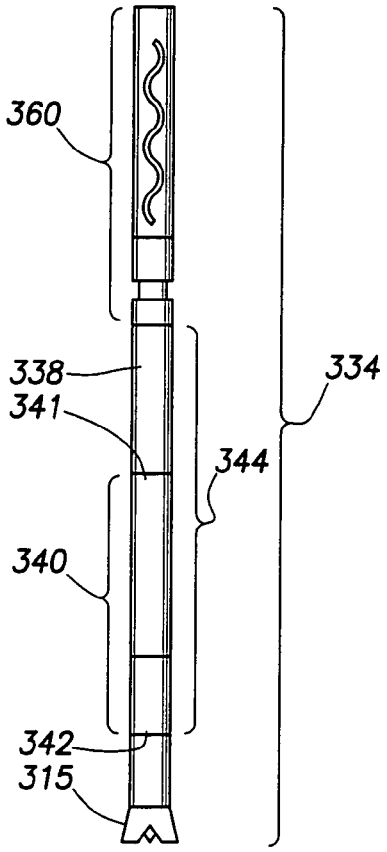
FIG. 3 is a schematic representation of a MWD tool having a mud-pulse telemetry system positioned beneath a mud motor in accordance with one embodiment according to the present invention.
Figure 4:
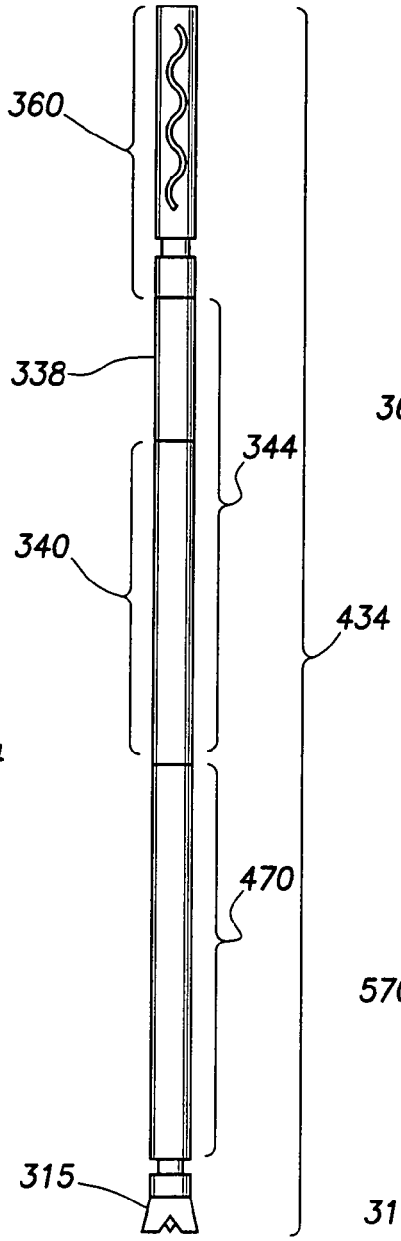
FIG. 4 is a schematic representation of a MWD tool having a mud-pulse telemetry system and being connected to a RSS, with both the MWD tool and the RSS being positioned in a drill string beneath a mud motor in accordance with another embodiment according to the present invention.
Figure 5:
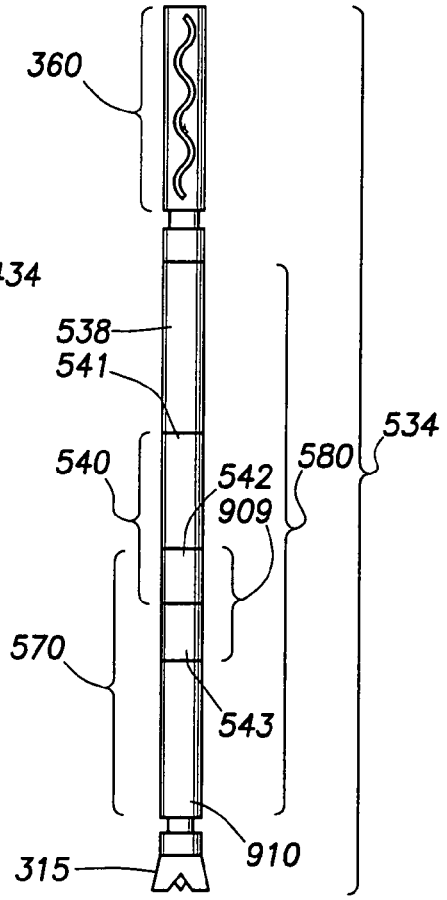
FIG. 5 is a schematic representation of a MWD tool having a mud-pulse telemetry system and being integrated with a RSS, with the integrated MWD/RSS system being positioned in a drill string beneath a mud motor in accordance with another embodiment according to the present invention.

FIGS. 3-5 are schematic representations of various tool assemblies or combinations having application in a BHA such as the BHA 134 of a conventional drill string 112 (see FIG. 1) or the BHA 234 of a casing drill string 212 (see FIG. 2). Turning first to FIG. 3, one embodiment of an apparatus for transmitting measurements while drilling according to the present invention comprises a measurement-while-drilling (MWD) tool 344 placed in the BHA 334 of a drill string (not otherwise shown) above a drill bit 315 and beneath a mud motor assembly 360.

Figure 6:
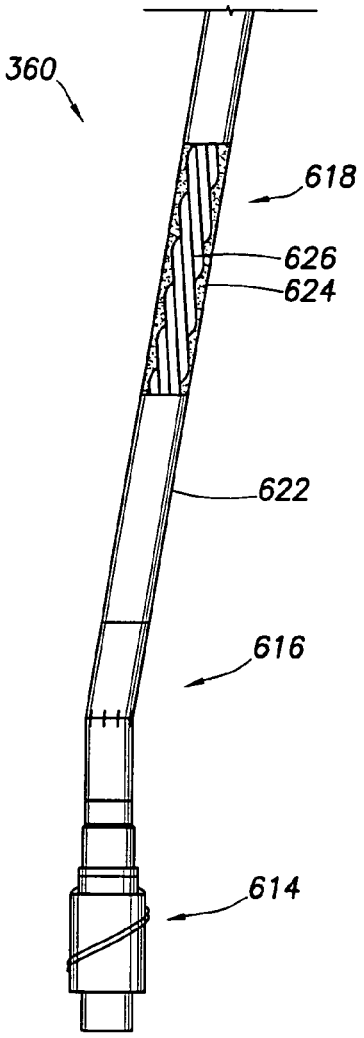
FIG. 6 is an elevational representation, partly in section, of a mud motor assembly having application in the present invention.

Mud motor assemblies, also known as progressive cavity motors or simply mud motors, are powered by circulating drilling fluid, also known as mud, through the drill string (see directional arrow 109 in FIG. 1) in which the mud motor is conveyed. FIG. 6 shows one embodiment of the mud motor 360 in greater detail, including a power section 618, a transmission section 616, and bearing/stabilizer section 614. The transmission section 616 may include a (fixed or adjustable) bent housing for use in directional drilling, but this is not an essential part of the motor assembly.

The power section 618 generally includes a tubular housing 622 which houses a motor stator 624 within which a motor rotor 626 is rotationally mounted. The power section 618 converts hydraulic energy into rotational energy by reverse application of the Moineau pump principle. The stator 624 typically consists of an elastomeric lining that provides a lobe structure for the stator. The rotor 626 is typically made of a suitable steel alloy (e.g., a chrome-plated stainless steel) and is dimensioned to form a tight fit (i.e., very small gaps or positive interference) within the stator under expected operating conditions. It is generally accepted that either or both the rotor and stator must be made compliant in order to form suitable hydraulic seals. The rotor 626 and stator 624 thereby form continuous seals along their matching contact points which define a number of progressive helical cavities. Accordingly, such an assembly is commonly called a progressive cavity motor (or a positive displacement motor). When mud is forced through these cavities, it causes the rotor 626 to rotate relative to the stator 624. During operation, mud is pumped through the drill string from the drilling rig at the earth's surface, passes through the motor power section 618, and ultimately exits the drill string through the drill bit.

Although a positive displacement-type mud motor has been described herein, the present invention is adaptive to other types of mud motors that are well known in the relevant art such as turbine-type mud motors. Thus, the motor power section 618 could be considered a turbine that performed a similar, if not identical, function to that of the above-described positive displacement motor.

Figure 7:
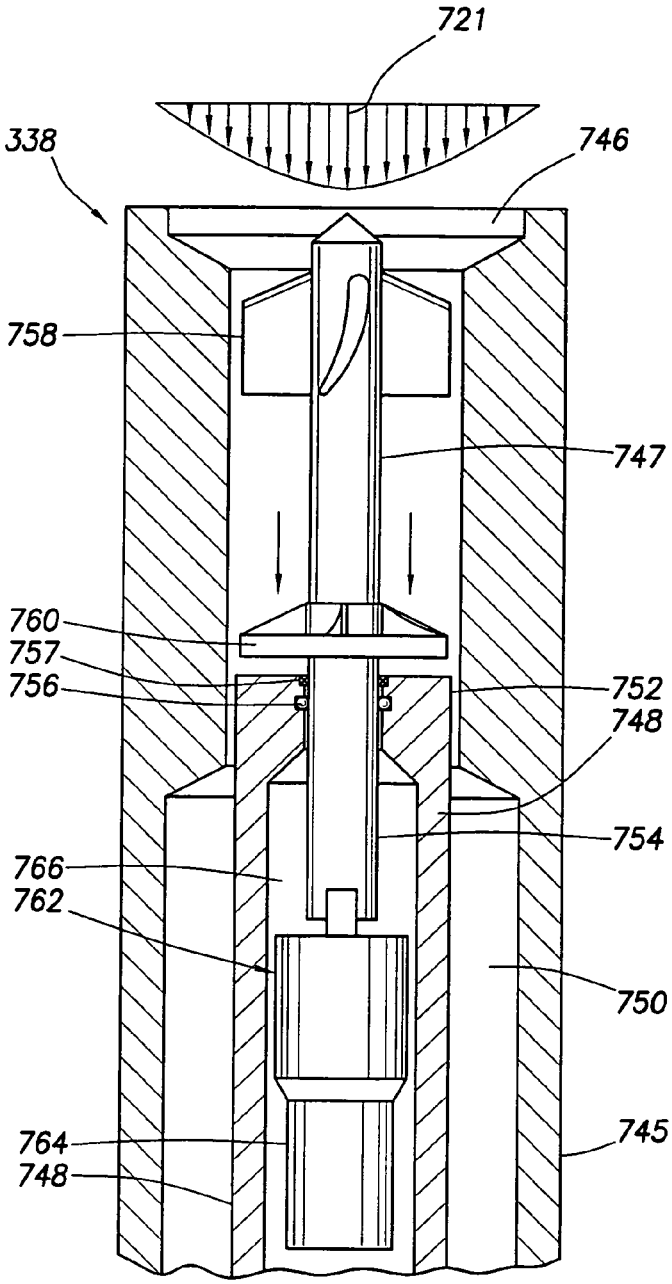
FIG. 7 is an elevational representation, partly in section, of a power and mud-pulse telemetry signal generator having application in the present invention.

With reference now to FIGS. 3 and 7, the MWD tool 344 is equipped with a telemetry and power subassembly 338 for transmitting mud-pulse telemetry signals upwardly through the mud motor and the drill string. The subassembly 338 powers and establishes communication with/for a MWD sensor and control electronics 342 within a lower subassembly 340 within the MWD tool that also houses a pressure compensator 341. The sensor electronics may include appropriate instrumentation for determining real-time drilling parameters such as direction, inclination, and toolface, among other things. It will be appreciated that the subassembly 338 may also communicate (by way of integration or otherwise) with the sensors of an LWD tool, although this is not shown in the figures for simplification and clarity.

One embodiment of the telemetry and power subassembly 338 is generally known as a modulator and turbine generator, and is illustrated schematically in FIG. 7. The subassembly 338 includes a sleeve 745 secured within the drill collar 344 (shown in FIG. 3). The sleeve 745 has an upper open end 746 into which the drilling fluid, or mud, flows in a downward direction as indicated by the downward arrow velocity profile 721. A stator 748, which also generally serves as a tool sub-housing, is secured against rotation relative to the drill collar 344 by being mounted within the flow sleeve 745, thereby creating an annular passage 750. The upper end of the stator 748 defines modulator stator blades 752.

A rotor 747 and drive shaft 754, which are secured concentrically for common rotation, are centrally mounted in the upstream end of the stator 748 by a rotary sealing/bearing assembly 756. The rotor 747 is disposed upstream of the stator 748, while the drive shaft 754 extends both upwardly out of the stator 748 and downwardly into the stator 748. A turbine impeller 758 is mounted at the upper end of the rotor 747 just downstream from the upper open end 746 of the sleeve 745. A modulator rotor 760 is mounted on the rotor 747 downstream of the turbine impeller 758 and immediately upstream of the modulator stator blades 752. The modulator rotor 760 and stator 748 cooperate to generate mud-pulse telemetry signals (also known as pressure-pulse telemetry signals)—having an amplitude exceeding several hundred pounds per square-inch (psi)—which are representative of the measured drilling parameters.

The modulator rotor/stator assembly acts as a valving system for intermittently restricting the flow of mud through the subassembly 338. More particularly, the speed of rotation of the modulator rotor 760 is adjusted by reference to the speed of rotation of an alternator 764 (described further below) as indicated by a tachometer (not shown). Control electronics in the subassembly 340 (more particularly in lower portion 342 thereof) include an electromagnetic braking circuit coupled to the tachometer and the stator windings of the alternator 764 for stabilizing (i.e., braking) the alternator speed and thus the speed of the modulator rotor 760 and thereby modulating the rotor to obtain the desired carrier frequency of the mudborne pressure wave. The generated telemetry signals are received at the surface by transducers, represented by reference numeral 131 (see FIG. 1), that convert the received acoustical signals to electronic signals S for further processing, storage, and use. It will be appreciated that the alternator output is reduced during braking periods, while the alternator 764 generates maximum power for the control and sensor electronics 342 during periods when braking is not applied.

It will be further appreciated by those having ordinary skill in the art that the transmission of telemetry signals upwardly through the mud motor 360 (see FIGS. 3 and 6) in this manner is contrary to conventional thinking. One aspect of the present invention therefore relates to the discovery that telemetry signals, such as mud-pulse telemetry signals, may be successfully transmitted through a mud motor, particularly at low transmission frequencies such as frequencies below approximately 1 Hz, but not necessarily limited to such. Thus, higher frequencies are also useful for transmitting such signals through a mud motor (e.g., positive displacement motors, turbo-drills, etc.).

Referring again to FIG. 7, the lower end of the drive shaft 754 is coupled to a gear train 762 which is mounted within the stator 748 and which, in turn, is coupled to an alternator 764. The gear train 762 adapts the drive shaft's rotational speed for optimum operation of the alternator 764. The alternator 764 is mounted in the stator 748 downstream of the gear train 762. The hydraulic energy of the high-pressure mud flow 721 is converted by the impeller 758 into rotation of the rotor 747 and drive shaft 754 which, in combination with the gear train 762, produces an angular velocity (speed) at the alternator shaft (not shown) sufficient to generate enough electrical energy within the alternator 764 to power the telemetry means (e.g., the modulator) and sensors, and—in some cases—other tools in the drill string bottom-hole assembly (BHA).

The drive shaft 754, bearings 756, gear train 762, and alternator 764 are all housed in a pressurized oil chamber 766 defined by the stator 748 (the lower portion of which is not shown in FIG. 7) in order to function in clean and well-lubricated conditions. Since the upstream portion of the drive shaft 754 is rotating in mud (drilling fluid), a rotary seal 757 is required to isolate the mud from the oil in the pressurized chamber 766. The face of a typical rotary seal 757 has to be lubricated by something other than the mud, since the mud contains erosive particles that will quickly ruin the rotary seal. This lubrication is achieved by ensuring a constant, low-volume oil leak from the pressurized chamber 766 across the rotary seal 757. This leak also prevents the flowing mud from invading the oil chamber 766, which is desirable since the cleanliness of the oil promotes a long operating life for the gears in the gear train 762, the bearing 756, and the electrical components (e.g., the alternator 764) inside the oil chamber.

A known solution for achieving this controlled leakage of oil across the rotary seal 757 is to employ a pressure compensator having compensating piston that is biased by a spring having an appropriate spring constant. The pressure compensator, referenced generally at 341 in FIG. 3, fluidly communicates with the pressurized oil chamber 766 to achieve the desired condition. The measurement sensor electronics and control electronics, indicated generally at 342 in FIG. 3, are fluidly-isolated from the pressure compensator 341 of the subassembly 340, but are typically hard-wired to the alternator 764 of the subassembly 338. Components similar to subassemblies 338, 340 are described in U.S. Pat. No. 5,517,464, which is incorporated herein in its entirety by reference. It will be appreciated by those having ordinary skill in the art that numerous other telemetry signal generators, such as mud-pulse signal generators, may be applied to advantage.

Turning now to FIG. 4, another embodiment of an apparatus for transmitting measurements while drilling according to the present invention comprises a MWD tool 344 placed in the BHA 434 of a drill string (not otherwise shown) above a drill bit 315 and beneath a mud motor assembly 360. The embodiment of FIG. 4 differs from the embodiment of FIG. 3 in that former also includes a rotary steerable system (RSS) 470 for directing the path of the drill bit 315 while the drill string, including the BHA 434, are being rotated from the surface.

As mentioned previously, there are generally two types of RSSs: point-the-bit systems and push-the-bit systems (although these may be combined in certain applications). In a point-the-bit RSS, the drill bit axis is offset from the BHA axis in similar fashion to a bent housing, and the drill bit axis is typically pointed in the desired direction of the borehole deviation by rotating devices in the BHA about the BHA axis. In a push-the-bit RSS, devices in the BHA press against the borehole wall to apply lateral reactive forces to the drill bit to push the drill bit axis in the direction of the desired borehole deviation.

Figure 8:
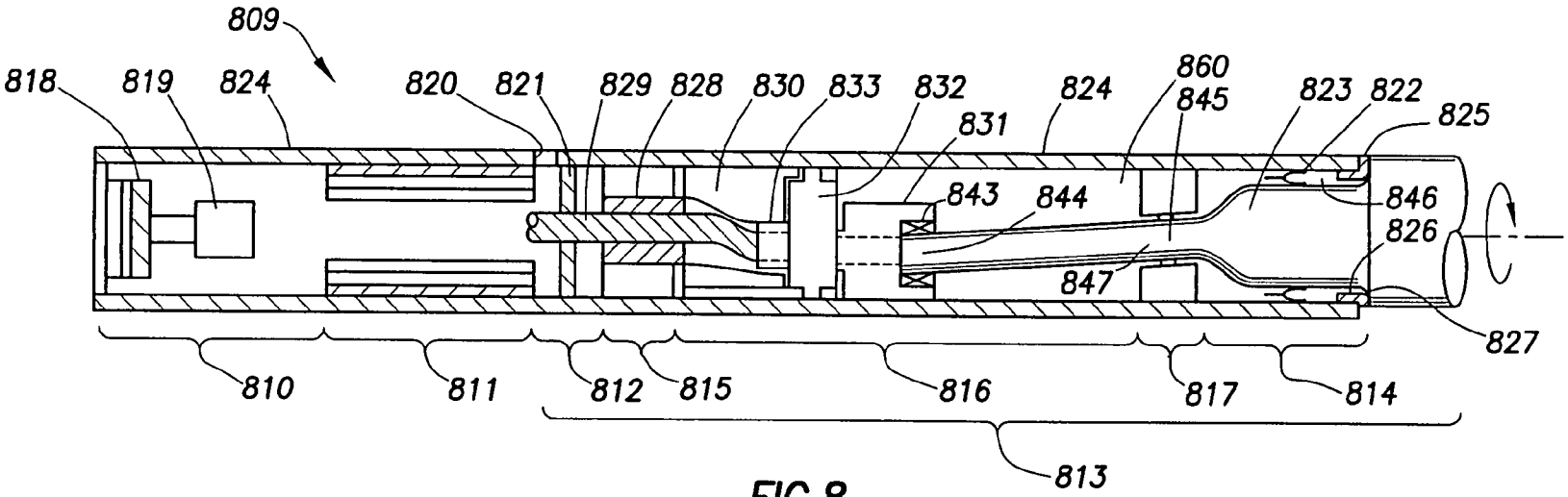
FIG. 8 is an elevational representation, partly in section, of a point-the-bit RSS having application in the present invention.

FIG. 8 is an elevational representation, partly in section, of a point-the-bit RSS 809 having application in the present invention. The rotary steerable drilling tool 809 includes at least three main sections: a power generation section 810, an electronics and sensor section 811 and a steering section 813.

The power generation section 810 comprises a turbine 818 which drives an alternator 819 to produce electric energy. The turbine 818 and alternator 819 preferably extract mechanical power from the mud and convert it to electrical power. The turbine preferably is driven by the mud which travels through the interior of the tool collar 824 down to the drill bit (315 in FIG. 4).

The electronics and sensor section 811 includes directional sensors (magnetometers, accelerometers, and/or gyroscopes, not shown separately) to provide directional control and formation evaluation, among others. The electronics and sensor section 811 may also provide the electronics that are needed to operate the RSS 809.

The steering section 813 includes a pressure compensation section 812, an exterior sealing section 814, a variable bit shaft angulating mechanism 816, a motor assembly 815 used to orient the bit shaft 823 in a desired direction, and the torque transmitting coupling system 817. Preferably, the steering section 813 maintains the bit shaft 823 in a geo-stationary orientation as the collar 824 rotates with the drill string.

The pressure compensation section 812 comprises at least one opening 820 in the tool collar 824 so that ambient pressure outside of the tool collar can be communicated to the chamber 860, which includes the steering section 813, via a piston 821. The piston 821 equalizes the pressure inside the steering section 813 with the pressure of the mud that surrounds the tool collar 824.

The exterior sealing section 814 protects the interior of the tool collar 824 from the drilling mud. This section 814 maintains a seal between the oil inside of the steering section 813 and external drilling (mud) by providing, at the lower end of the tool collar 824, a bellows seal 822 between the bit shaft 823 and the tool collar 824. The bellows 822 may allow the bit shaft 823 to freely angulate so that the bit (315 in FIG. 4) can be oriented as needed. The steering section 813 is compensated to the exterior mud by the pressure compensation section 812 described above, permitting the bellows 822 to be made of a thinner material. This makes the bellows 822 more flexible and minimizes the alternative stresses resulting from bending during operation to increase the life of the bellows.

A bellows protector ring 825 may also be provided to closes a gap 846 between the bit shaft 823 and the lower end of the tool collar 824. As can be seen in FIG. 8, the bit shaft 823 is preferably conformed to a concave spherical surface 826 at the portion where the tool collar 824 ends. This surface 826 mates with a matching convex surface 827 on the bellows protector ring 825. Both surfaces 826, 827 have a center point that is coincident with the center of the torque transmitting coupling 847. As a result, a spherical interface gap 846 is formed that is maintained as the bit shaft 823 angulates. The size of this gap 846 is controlled such that the largest particle of debris that can enter the interface is smaller than the gap between the bellows 822 and bit shaft 823, thereby protecting the bellows 822 from puncture or damage.

The motor assembly 815 operates the variable shaft angulating mechanism 816 which orientates the drill bit shaft 823. The variable bit shaft angulating mechanism 816 comprises the angular motor, an offset mandrel 830, a variable offset coupling 831, and a coupling mechanism 832. The motor assembly 815 is an annular motor that has a tubular rotor 828. Its annular configuration permits all of the steering section 813 components to have larger diameters, and larger load capacities than otherwise possible. The use of an annular motor also increases the torque output and improves cooling as compared with other types of motors. The motor may further be provided with a planetary gearbox and resolver (not shown), preferably with annular designs.

The tubular rotor 828 provides a path for the mud to flow along the axis of the RSS 809 until it reaches the variable bit shaft angulating mechanism 816. Preferably, the mud flows through a tube 829 that starts at the upper end of the annular motor assembly 815. The tube 829 goes through the annular motor 815 and bends at the variable bit shaft angulating mechanism 816 reaching the drill bit shaft 823 where the mud is ejected into the drill bit (315 in FIG. 4). The presence of the tube 829 avoids the use of dynamic seals to improve reliability.

Alternate embodiments may, or may not include the tube. For example, the mud may enter the upper end of the annular motor assembly 815, passes through the tubular rotor shaft, passes the variable shaft angle mechanism 816 and reaches the tubular drill bit shaft 823 where the mud is ejected into the drill bit. This embodiment requires two rotating seals; one where the mud enters the variable shift angle mechanism at the tubular rotor shaft and the other where the mud leaves the tubular rotor shaft. In this embodiment, the fluid is permitted to flow through the tool.

Angular positioning of the bit relative to the tubular tool collar is performed by the variable bit shaft angulating mechanism 816. The variation in the angular position of the bit is obtained by changing the location of the bit shaft's upper end 844 around the corresponding cross section of the tool collar 824 while keeping a point 845 of the bit shaft 823, close to the lower end of the tool collar 824, fixed.

The bit shaft upper end 844 is attached to the lower end of the variable offset coupling 831. Therefore, any offset of the variable offset coupling 831 will be transferred to the bit. Preferably, the attachment is made through a bearing system 843 that allows it to rotate in the opposite direction with respect to the rotation of the variable offset coupling 831. The offset mandrel 830 is driven by the steering motor to maintain tool-face while drilling, and has an offset bore 833 on its right end.

The torque transmitting coupling system 817 transfers torque from the tool collar 824 to the drill bit shaft 823 and allows the drill bit shaft 823 to be aimed in any desired direction. In other words, the torque-transmitting coupling system 817 transfers loads, rotation and/or torque from, for example, the tool collar 824 to the bit shaft 823. A system similar to RSS 809 is described in U.S. Patent Application Publication No. 2004/0104051, the entire contents of which are incorporated herein by reference.

Referring now to FIG. 5, a schematic representation of a MWD tool having a mud-pulse telemetry system 538 and being integrated (preferably within a common drill collar) with a RSS 570 is shown in the BHA 534 of a drill string (not otherwise shown). The integrated MWD/RSS tool 580 is positioned in a drill string beneath a mud motor 360 in accordance with another embodiment according to the present invention. The telemetry system 538 is very similar to the telemetry system 338 described above, and will not be separately described. The RSS 570 may be a point-the-bit system (as described above for RSS 809) or a push-the-bit system as described below. The systems 538, 570 are interconnected by a subassembly 540 which provides common measuring and control functions thereto, as described further below.

Figure 9B:
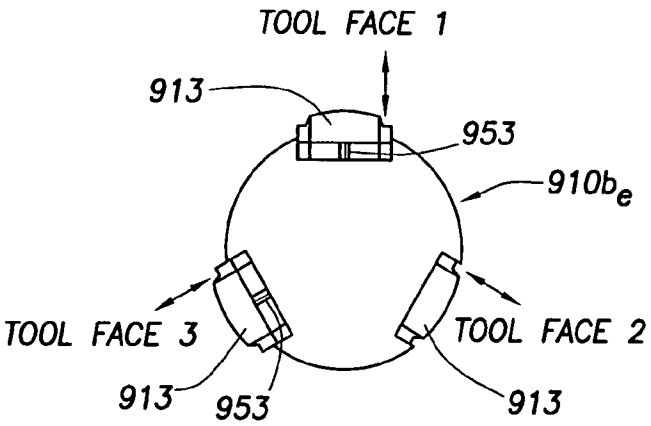
FIG. 9B is a cross-sectional representation of the push-the-bit RSS of FIG. 9A, taken along section line 9B-9B.
Figure 9A:
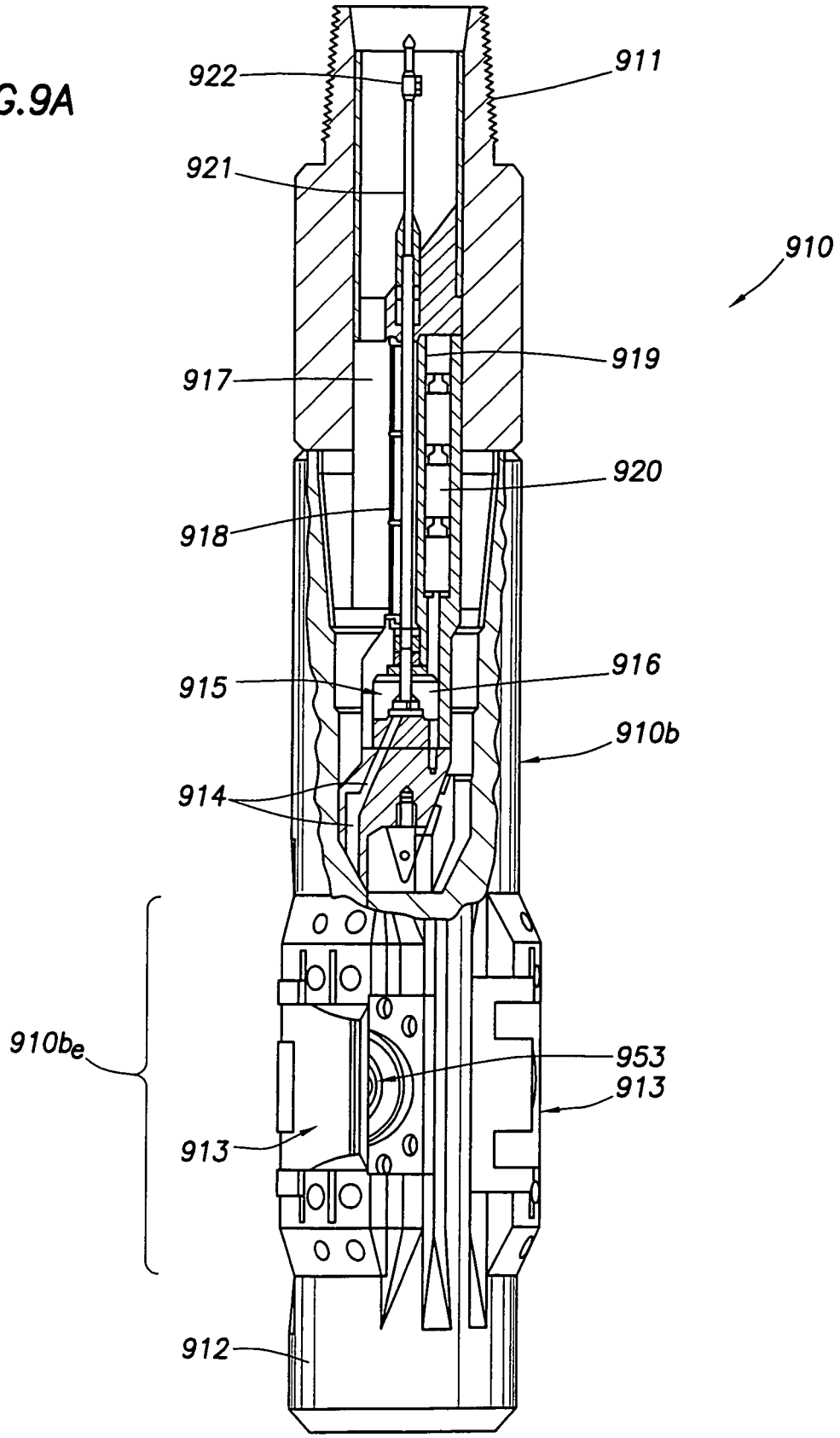
FIG. 9A is an elevational representation, partly in section, of a push-the-bit RSS also having application in the present invention, with the push-the-bit RSS being integrated with a MWD system according to FIG. 5.

FIG. 9A is an elevational representation, partly in section, of a push-the-bit RSS 570 also having application in the present invention. The push-the-bit RSS 570 is integrated with a MWD system according to FIG. 5, particularly by the sharing of a common measurement, control, and pressure-compensation subassembly 540. The RSS 570 includes at least three main sections: a power generation section (not numbered), a measurement sensor and control section 909, and a steering section 910. The power generation section is similar to the power generation section 810 of FIG. 8, and will not be further described herein. The measurement sensor and control section, or subassembly 909 includes "strap-down" sensors 543 for determining the position of the section 909 with respect to gravity and the position of the disc valve 915 (described below), so as to determine which pads 913 (also described below) to actuate. Additional electronics 542, such as direction, inclination, and tool face sensor electronics, as well as communication electronics (of signals and power), are commonly shared with the telemetry system 538 by way of the subassembly 540 (see FIG. 5). Thus, the electronics of the subassemblies 540 and 909 serve both the MWD telemetry subassembly 538 and the RSS 570, and thereby eliminate some redundancy by combining the measurement and control functions of the two subsystems.

It will be appreciated by those skilled in the art that additional redundancy may be eliminated by a common pressure compensation system (referenced as 541 in FIG. 5), which serves the MWD telemetry components as described above with reference to subassembly 338 of FIG. 3, and which may also serve a point-the-bit or a push-the-bit RSS that benefited from pressure compensation (see, e.g., the discussion concerning oil-lubricated steering section 813 above).

Turning again to FIG. 9A, the steering section 910, also known as a modulated bias unit, comprises an elongated main body structure 910*b* provided at its upper end with a threaded pin 911 for connecting the unit to a drill collar incorporating the measurement sensor and control section 909. The lower end 912 of the body structure 910*b* is formed with a socket to receive the threaded pin of the drill bit 315 (see FIG. 5). The drill bit may be of any type suitable for the formation being drilled.

Three equally-spaced hydraulically-actuated pads 913 are carried for extension and retraction in an enlarged diameter portion 910$b_e$ of the body structure 910*b*. Each pad 913 is part of an assembly (not separately numbered) that is supplied with drilling fluid under pressure through a respective passage 914 under the control of a rotatable disc control valve 915 located in a cavity 916 in the body structure 910*b* of the bias unit 910. The pads 913 are operable, e.g., for stabilizing the drill string at a specific position within the borehole's cross section, or for changing the direction of the drill bit (315 in FIG. 5). The pads 913 are preferably actuated (i.e., extended or retracted) by the mud passing through the RSS 570 as will be described more fully below.

Drilling fluid delivered under pressure downwardly through the interior of the drill string in the normal manner (see arrow 109 in FIG. 1) passes into a central passage 917 in the upper part of the bias unit. From here, the drilling fluid (or mud) passes through a filter 918 consisting of closely spaced longitudinal wires, and through an inlet 919 into the upper end of a vertical multiple choke unit 920 through which the drilling fluid is delivered downwardly at an appropriate pressure to the cavity 916.

The disc control valve 915, disposed in the cavity 916, is controlled by an axial shaft 921 which is connected by a coupling 922 to an output shaft (not shown) of the measurement sensor and control section 909. The measurement sensor and control section 909 maintains the shaft 921 substantially stationary (e.g., by counter-rotation thereof) at a rotational orientation which is selected, either from the surface or by a downhole control electronics (e.g., in section 909), according to the direction in which the drill bit is to be steered. As the body structure 910*b* rotates with the drill string around the stationary shaft 921, the disc valve 915 operates to selectively deliver drilling fluid under pressure to the three hydraulically-actuated pads 913 in succession. The hydraulic pads 913 are thus actuated in succession as the bias unit rotates, each in the same rotational orientation or position, so as to displace the bias unit laterally in a selected direction. The selected rotational position of the shaft 921 in space thus determines the direction in which the bias unit 910 is actually displaced and hence the direction in which the drill bit is steered.

The number of actuator pads 913 and/or their dimension can vary and depends on the degree of control required. The number of pads preferably varies between a minimum of three and a maximum of five pads for achieving suitable control. As the number of pads increase, better positional control may be achieved. However, as this number increases, the complexity of the activation mechanism also increases. Preferably, up to five pads may be used before the activation becomes too complex. However, where the dimensions are altered, the number, position and dimension of the pads may also be altered.

In the three-actuator pad system shown in the cross-sectional representation of FIG. 9B, the pads 913 extend and retract radially from the enlarged body portion 910$b_e$. By varying which set of pistons is extended or retracted, eight settings can be obtained with the following sequence, by way of example:

1. Pistons set #1 full gauge, set #2 and #3 under gauge: Tool Face 1=X;
2. Pistons set #1 and #2 full gauge, set #3 under gauge: Tool Face 2=X+60 degrees;
3. Pistons set #2 full gauge, set #1 and #3 under gauge: Tool Face 3=X+120 degrees;
4. Pistons set #2 and #3 full gauge, set #1 under gauge: Tool Face 4=X+180 degrees;
5. Pistons set #3 full gauge, set #1 and #2 under gauge: Tool Face 5=X+240 degrees;
6. Pistons set #1 and #3 full gauge, set #2 under gauge (shown in FIG. 9B): Tool Face 6=X+300 degrees;
7. Pistons set #1, #2 and #3 full gauge: Tool Face 7=0 degrees; and
8. Pistons set #1, #2 and #3 under gauge: Tool Face 8=180 degrees.

The tool face increment in this example is 60 degrees. The initial value "X" of the tool face depends on the angular position of the sliding sleeve. In the worst case, the difference between desired tool face and actual tool face is 30 degrees. With additional blades, the number of setting cycles would increase as a function of the equation:

$$s=2n,$$

where s is the total possible number of settings and n is the number of blades. The number s can be reduced with the realization that all combinations are not necessary for downhole control when dealing with more than 3 blades.

In summary, the valve 915 can provide continuous and/or selective mud to conduit(s) 914. The pistons 953 are activated by flow which is bypassed through the drilling tool along the hydraulic conduits 914. The pistons 915 extend and retract the pads 913 as desired. The measurement and control section sensors 543 detect the position of the subassembly 909 as it moves through the borehole. By selectively activating the pistons to extend and retract the pads as described herein, the downhole tool may be controlled to change the borehole tendency and drill the wellbore along a desire path.

A suitable push-the-bit RSS for implementation by the RSS 570 is described in U.S. Pat. No. 6,089,332, except the RSS of the '332 patent is coupled with a roll-stabilized control system rather than a strap-down system. Both control systems are suitable, but the strap-down type of control system is preferred for integrated MWD/RSS solution as shown and described in reference to FIG. 5. Examples of roll-stabilized or gimbaled control systems are described in the following U.S. Pat. Nos. 5,803,185; 5,706,905; 5,695,015; 5,685,379; 5,582,259; 5,553,678; 5,520,255; 5,265,682.

All of the above systems, subsystems, and components are suitable for implementation in both conventional and casing drilling operations. Thus, in particular embodiments, the drill string comprises a plurality of interconnected drill pipe joints (as in FIG. 1) or a plurality of interconnected casing joints (as in FIG. 2).

In conclusion, it will be appreciated that the present invention (in its various forms and characteristics) is well suited for transmitting downhole measurements while drilling with a drill string having a mud motor and a drill bit. Telemetry signals, such as mud-pulse telemetry signals, are generated beneath the mud motor that are representative of one or more measured formation parameters. The generated telemetry signals are transmitted upwardly through the mud motor and the drill string—something that is quite contrary to convention wisdom—especially at frequencies below approximately 1 Hz. In particular embodiments, the drill bit is steered with a rotary steerable system (acting alone or in combination with the mud motor) carried in the drill string beneath the mud motor.

It will be understood from the foregoing description that various modifications and changes may be made in the preferred and alternative embodiments of the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open set or group. Similarly, the terms "containing," having," and "including" are all intended to mean an open set or group of elements. "A," "an" and other singular terms are intended to include the plural forms thereof unless specifically excluded.

What is claimed is:

1. An apparatus for transmitting measurements while drilling with a drill string equipped with a mud motor, the apparatus comprising:

a measurement-while-drilling tool for placement in the drill string wholly beneath the mud motor such that sensing and signal transmission are performed beneath the mud motor, the measurement-while-drilling tool having a system for transmitting mud pulse telemetry signals upwardly through the mud motor and the drill string to the surface at frequencies below approximately 1 Hz; and a rotary steerable system for placement in the drill beneath the mud motor.

2. The apparatus of claim 1, wherein the mud motor comprises a positive displacement motor.

3. The apparatus of claim 1, wherein the mud motor comprises a turbine.

4. The apparatus of claim 1, wherein the drill string comprises a plurality of interconnected drill pipe joints.

5. The apparatus of claim 1, wherein the drill string comprises a plurality of interconnected casing joints.

6. An apparatus for transmitting measurements while drilling with a drill string equipped with a mud motor, the apparatus comprising:

a measurement-while-drilling tool for placement in the drill string wholly beneath the mud motor such that sensing and signal transmission are performed beneath the mud motor, the measurement-while-drilling tool having a system for transmitting mud pulse telemetry signals upwardly through the mud motor and the drill string to the surface at frequencies below approximately 1 Hz, wherein the telemetry system comprises a valving system for intermittently restricting the flow of mud through the measurement-while drilling tool.

7. The apparatus of claim 1, wherein the rotary steerable system is a point-the-bit system.

8. The apparatus of claim 1, wherein the rotary steerable system is a push-the-bit system.

9. The apparatus of claim 1, wherein the rotary steerable system and the measurement-while-drilling are integrated into a common tool housing.

10. A system for transmitting measurement while drilling comprising:

a drill string having a drill at one end thereof for drilling a borehole through a subsurface formation;

a mud motor carried in the drill string above the drill bit;

a measurement-while-drilling tool carried in the drill string for transmitting telemetry signals upwardly through the mud motor and drill string to a surface location using mud pulse telemetry at frequencies below approximately 1 Hz; and a rotary steerable system carried in the drill string beneath the mud motor.

11. The system of claim 10, wherein the drill string comprises a plurality of interconnected drill pipe joints.

12. The system of claim 10, wherein the drill string comprises a plurality of interconnected casing joints.

13. The system of claim 10, wherein the rotary steerable system and the measurement-while-drilling tool are integrated into a common tool housing.

14. For use in a drill string having a mud motor and drill bit, a method of transmitting measurements while drilling, comprising the steps of:

measuring one or more parameters of a subsurface formation penetrated by the drill string;

generating telemetry signals beneath the mud motor that are representative of the measured for formation parameters, the generated signals being transmitted upwardly through the mud motor and the drill string to a surface location using mud pulse telemetry at frequencies below approximately 1 Hz; and steering the drill bit with a rotary steerable system carried in the drill string beneath the mud motor.

15. The method of claim 14, wherein the drill string comprises a plurality of interconnected drill pipe joints.

16. The method of claim 14, wherein the drill string comprises a plurality of interconnected casing joints.

17. The method of claim 14, wherein the rotary steerable system is a point-the-bit system.

18. The method of claim 14, wherein the rotary steerable system is a push-the-bit system.

19. The method of claim 14, wherein the rotary steerable system and the measurement-while-drilling tool are integrated into a common tool housing.

20. For use in a drill string having a mud motor and drill bit, a method of transmitting measurements while drilling, comprising the steps of:

measuring one or more parameters of a subsurface formation penetrated by the drill string; and generating telemetry signals beneath the mud motor that are representative of the measured for formation parameters, the generated signals being transmitted upwardly through the mud motor and the drill string using mud pulse telemetry at frequencies below approximately 1 Hz, wherein the step of generating mud-pulse telemetry signals comprises intermittently restricting the flow of mud through a measurement-while drilling tool carried in the drill string beneath the mud motor.

* * * * *